US011221162B2

(12) United States Patent
Kao et al.

(10) Patent No.: US 11,221,162 B2
(45) Date of Patent: Jan. 11, 2022

(54) ROLL BOND PLATE EVAPORATOR STRUCTURE

(71) Applicant: ASIA VITAL COMPONENTS (CHINA) CO., LTD., Shenzhen (CN)

(72) Inventors: Pai-Ling Kao, Shenzhen (CN); Dan-Jun Chen, Shenzhen (CN); Guo-Hui Li, Shenzhen (CN); Fu-Ming Zhong, Shenzhen (CN)

(73) Assignee: Asia Vital Components (China) Co., Ltd., Shenzhen (CN)

( * ) Notice: Subject to any disclaimer, the term of this patent is extended or adjusted under 35 U.S.C. 154(b) by 24 days.

(21) Appl. No.: 16/423,127

(22) Filed: May 27, 2019

(65) Prior Publication Data

US 2020/0378661 A1 Dec. 3, 2020

(51) Int. Cl.
*F25B 39/02* (2006.01)
*F25D 23/06* (2006.01)

(52) U.S. Cl.
CPC ..... *F25B 39/022* (2013.01); *F25D 23/061* (2013.01)

(58) Field of Classification Search
CPC ..... F25B 39/022; F25B 39/02; F28F 3/042; F28F 3/00; F25D 23/061; F28D 15/0233
See application file for complete search history.

(56) References Cited

U.S. PATENT DOCUMENTS

| | | | | |
|---|---|---|---|---|
| 2,821,845 | A * | 2/1958 | Thomas | F25B 39/024 62/527 |
| 4,093,024 | A * | 6/1978 | Middleton | F24S 10/506 165/170 |
| 2014/0284033 | A1* | 9/2014 | Zima | F28D 21/0003 165/166 |
| 2016/0178292 | A1* | 6/2016 | Matsui | F28F 9/0265 165/104.21 |
| 2016/0262284 | A1* | 9/2016 | Li | F28D 1/0477 |
| 2018/0266738 | A1* | 9/2018 | Li | F28D 1/035 |
| 2019/0360762 | A1* | 11/2019 | Aoki | F28D 15/0283 |
| 2019/0368823 | A1* | 12/2019 | Chan | B21D 53/045 |

FOREIGN PATENT DOCUMENTS

| | | | |
|---|---|---|---|
| CN | 206330307 U | | 7/2017 |
| JP | 11277167 A | * | 10/1999 |
| JP | 2003-291241 A | | 10/2003 |

* cited by examiner

*Primary Examiner* — Emmanuel E Duke
(74) *Attorney, Agent, or Firm* — Bradley J. Thorson; DeWitt LLP

(57) ABSTRACT

A roll bond plate evaporator structure is disclosed. The roll bond plate evaporator structure includes a heat dissipation member, at least one inlet and at least one outlet. The heat dissipation member is composed of a first plate body and a second plate body, which are correspondingly mated with each other. The first and second plate bodies together define a flow way. A working fluid is filled in the flow way. The inlet is formed at one end of the heat dissipation member in communication with the flow way and the outlet is formed at the other end of the heat dissipation member in communication with the flow way.

1 Claim, 2 Drawing Sheets

ROLL BOND PLATE EVAPORATOR STRUCTURE

BACKGROUND OF THE INVENTION

1. Field of the Invention

The present invention relates generally to a roll bond plate evaporator structure, and more particularly to a roll bond plate evaporator structure which can enhance the sealability of the inlet and the outlet and greatly reduce the possibility of leakage of the working fluid.

2. Description of the Related Art

The operation performances of the current mobile devices, personal computers, servers, communication chassis and other systems or devices have become higher and higher. As a result, the heat generated by the internal operation units of these electronic devices has become higher and higher. Therefore, it is necessary to use heat dissipation units to dissipate the heat. Most of the manufacturers employ the heat sink (composed of multiple radiating fins), heat pipe, vapor chamber and other heat dissipation components in cooperation with cooling fans to dissipate the heat. In case of large-area heat dissipation, a heat dissipation device (heat sink) and cooling fan are used to forcedly dissipate the heat.

In the current market, some manufacturers have employed roll bond plate evaporator to replace the conventional radiating fin. During the manufacturing process of the roll bond plate evaporator, in both the roll bond process and the welding process, the roll bond plate evaporator is brushed with graphite powder and sprayed with welding flux to facilitate the successive manufacturing step. As a result, impurities will exist in the flow way of the roll bond plate evaporator and is hard to clean up. When vacuuming the flow way, the impurities in the flow way may be also sucked out to accumulate in the vacuuming device. This may lead to damage of the vacuuming device and shorten the lifetime of the vacuuming device. Moreover, when filling a working fluid into the roll bond plate evaporator and sealing the opening of the roll bond plate evaporator, due to the existence of the impurities in the flow way, it is difficult to tightly seal the opening in the welding process. Therefore, the working fluid is apt to leak out. This greatly increases the ratio of defective products.

In summary, the conventional roll bond plate evaporator has the following shortcomings:

1. It is difficult to tightly seal the opening.
2. The working fluid is apt to leak out.
3. The vacuuming device is easily damaged.

It is therefore tried by the applicant to provide a roll bond plate evaporator structure and a manufacturing method thereof to solve the problems existing in the conventional roll bond plate evaporator structure.

SUMMARY OF THE INVENTION

It is therefore a primary object of the present invention to provide a roll bond plate evaporator structure, which can greatly enhance the sealability of the inlet and the outlet.

It is a further object of the present invention to provide the above roll bond plate evaporator structure, which can greatly lower the possibility of leakage of the working fluid.

It is still a further object of the present invention to provide the above roll bond plate evaporator structure, which can greatly increase the ratio of good products.

It is still a further object of the present invention to provide the above roll bond plate evaporator structure, which can avoid damage of the vacuuming device.

To achieve the above and other objects, the roll bond plate evaporator structure of the present invention includes a heat dissipation member, at least one inlet and at least one outlet. The heat dissipation member is composed of a first plate body and a second plate body, which are correspondingly mated with each other. The first and second plate bodies together define a flow way. A working fluid is filled in the flow way. The inlet is formed at one end of the heat dissipation member in communication with the flow way and the outlet is formed at the other end of the heat dissipation member in communication with the flow way.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
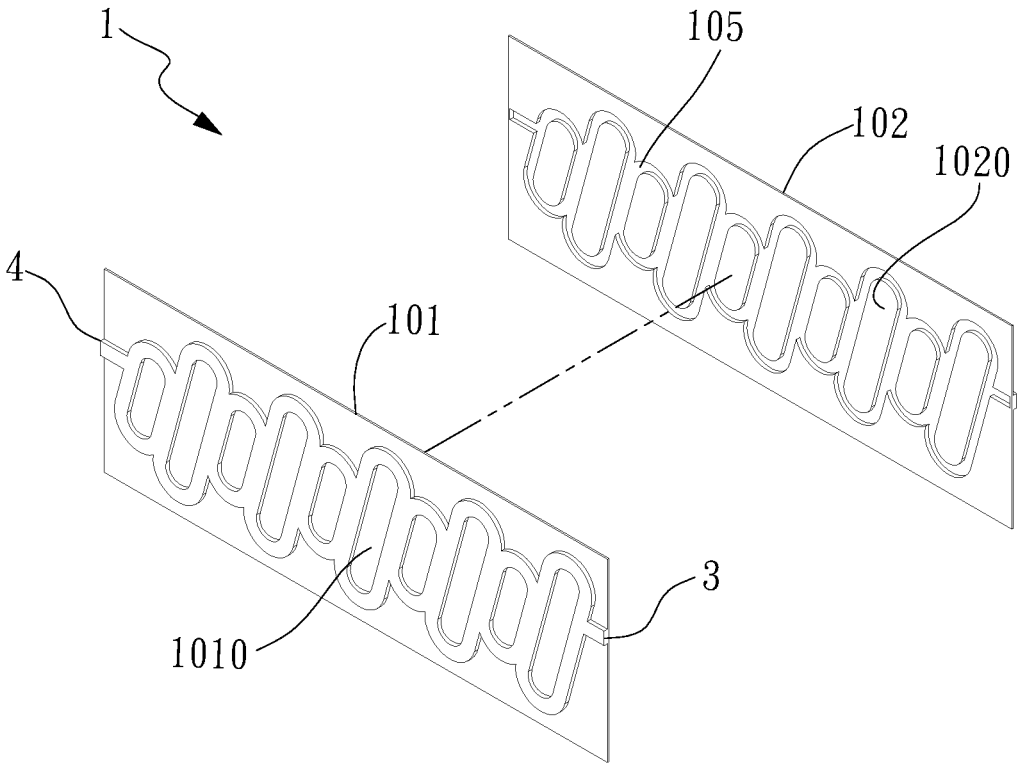
FIG. 1 is a perspective exploded view of a first embodiment of the roll bond plate evaporator structure of the present invention.
Figure 2:
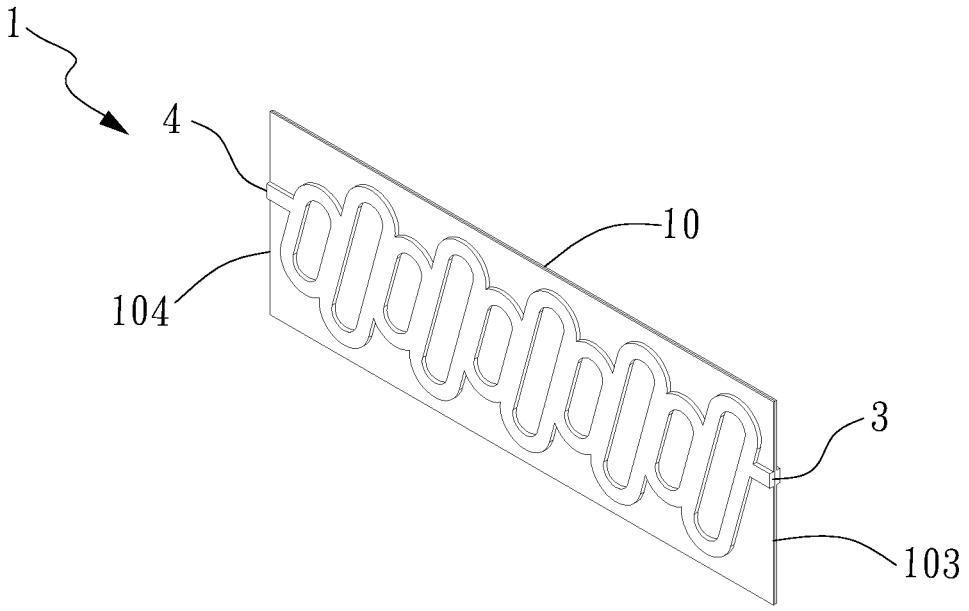
FIG. 2 is a perspective assembled view of the first embodiment of the roll bond plate evaporator structure of the present invention.
Figure 3:
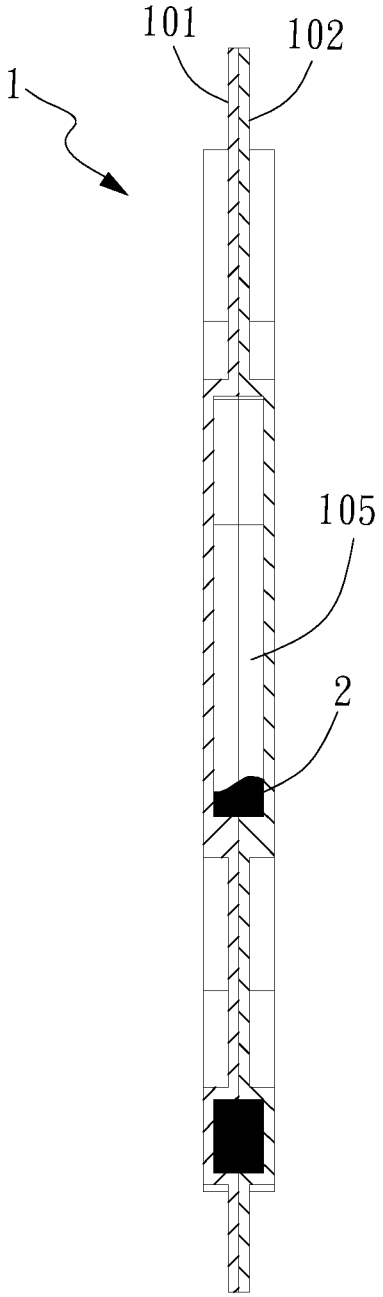
FIG. 3 is a sectional view of the first embodiment of the roll bond plate evaporator structure of the present invention.

Please refer to FIGS. 1 to 3. FIG. 1 is a perspective exploded view of a first embodiment of the roll bond plate evaporator structure of the present invention. FIG. 2 is a perspective assembled view of the first embodiment of the roll bond plate evaporator structure of the present invention. FIG. 3 is a sectional view of the first embodiment of the roll bond plate evaporator structure of the present invention. As shown in the drawings, the roll bond plate evaporator structure 1 of the present invention includes a heat dissipation member 10, at least one inlet 3 and at least one outlet 4. The heat dissipation member 10 is composed of a first plate body 101 and a second plate body 102, which are correspondingly mated with each other. The heat dissipation member 10 has a first end 103 and a second end 104. The first plate body 101 has multiple first recesses 1010 and the second plate body 102 has multiple second recesses 1020. The first and second plate bodies 101, 102 are correspondingly mated with each other with the first and second recesses 1010, 1020 correspondingly attached to each other, whereby the outer peripheries of the first and second recesses 1010, 1020 are connected with each other to form a flow way 105. A working fluid 2 is filled in the flow way 105. The inlet 3 is formed at the first end 103 of the heat dissipation member 10, while the outlet 4 is formed at the second end 104 of the heat dissipation member 10. The inlet 3, the outlet 4 and the flow way 105 communicate with each other.

Figure 4:
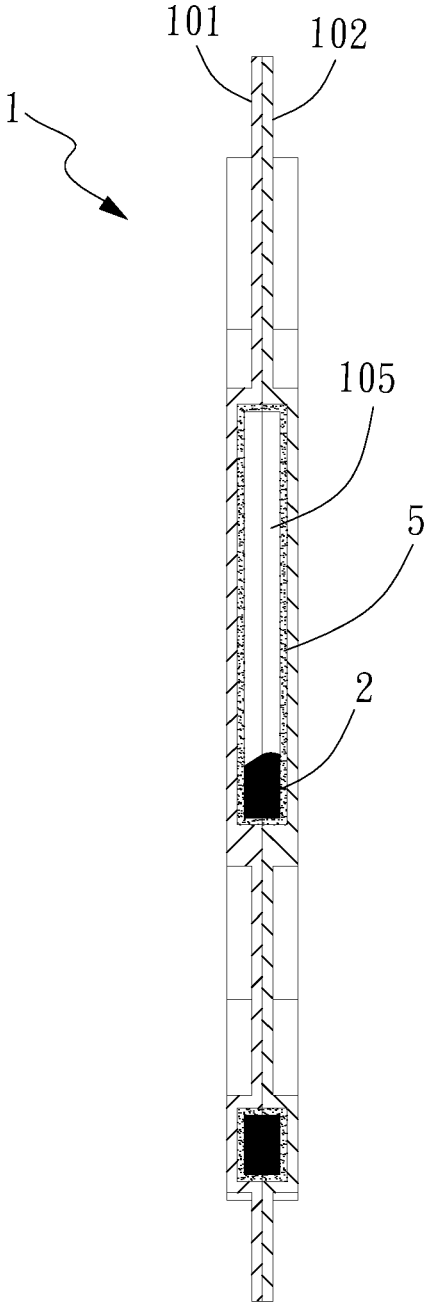
FIG. 4 is a sectional view of a second embodiment of the roll bond plate evaporator structure of the present invention.

Please further refer to FIG. 4, which is a sectional view of a second embodiment of the roll bond plate evaporator structure of the present invention. In this embodiment, at least one capillary structure 5 is disposed on the inner wall of the flow way 105. The capillary structure 5 is selected from a group consisting of mesh body, fiber body, porous structure body, channeled body and whisker and any combination thereof. The capillary structure 5 serves to enhance the vapor-liquid circulation of the working fluid 2 in the heat dissipation member 10.

In conclusion, in comparison with the conventional structure, the present invention has the following advantages:

1. The sealability of the inlet and the outlet is greatly enhanced.
2. The possibility of leakage of the working fluid is greatly lowered.
3. The ratio of good products is greatly increased.
4. The damage of the vacuuming device is avoided.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A roll bond plate evaporator structure comprising: a heat dissipation member composed of a first plate body having multiple first recesses, second plate body having multiple second recesses, a first end and a second end, the first plate body and the second plate body being correspondingly mated with each other, the multiple first recesses and the multiple second recesses being correspondingly attached to each other to together define a vacuum flow way, a working fluid being filled in the vacuum flow way; at least one capillary structure disposed on an inner wall of the vacuum flow way; at least one inlet formed at the first end of the heat dissipation member in communication with the vacuum flow way; and at least one outlet being formed at the second end of the heat dissipation member in communication with the vacuum flow way, wherein the first and second ends respectively positioned at two opposite and different sides of the heat dissipation member, and where the at least one inlet and at least one outlet are sealed following the filling of the vacuum flow way with the working fluid so that the working fluid and the at least one capillary structure are sealed within the vacuum flow way.

* * * * *